US006231351B1

(12) United States Patent
Lin et al.

(10) Patent No.: US 6,231,351 B1
(45) Date of Patent: May 15, 2001

(54) ELECTRICAL CONNECTOR

(75) Inventors: Willy Lin; Yih-Sin Chen, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/397,180

(22) Filed: Sep. 16, 1999

(30) Foreign Application Priority Data

May 18, 1999 (TW) ..... 88207964

(51) Int. Cl.[7] ..... H01R 12/00
(52) U.S. Cl. ..... 439/64; 439/102
(58) Field of Search ..... 439/64, 541.5, 439/345, 102

(56) References Cited

U.S. PATENT DOCUMENTS 5,290,174 * 3/1994 Woratyla et al. ..... 439/541.5
5,588,850 * 12/1996 Pan et al. ..... 439/64
5,613,860 * 3/1997 Banakis et al. ..... 439/64
5,653,596 * 8/1997 Banakis et al. ..... 439/64

* cited by examiner

*Primary Examiner*—Tulsidas Patel
(74) *Attorney, Agent, or Firm*—Wei Te Chung

(57) ABSTRACT

An electrical connector comprises an insulative housing, a number of contacts received in the housing and a pair of retention devices. The housing comprises an elongate base defining a slot for receiving an edge of a card therein and a pair of arms laterally extending from opposite ends of the base. Each arm comprises a spring cantilever and an aperture. Each retention device comprises a main portion, a spring arm and a horizontal solder pad for being soldered to a printed circuit board. The retention device is assembled to the corresponding arm with the main portion movably received in the aperture to ensure coplanarity between the horizontal solder pad and a bottom surface of the housing when the connector is mounted on a printed circuit board.

6 Claims, 4 Drawing Sheets

ELECTRICAL CONNECTOR

BACKGROUND OF THE INVENTION

The present invention relates to a connector, and particularly to a connector having a pair of retention devices adjustably retained in an insulative housing thereof to ensure coplanarity with a printed circuit board on which the connector is mounted.

Description of the Prior Art

Taiwan Patent Application Nos. 83106533 and 83210289 each disclose a connector comprising an insulative housing having a pair of arms, a plurality of contacts received in the housing and a pair of retention devices respectively retained in the arms. A conventional connector 10' is illustrated in FIGS. 1 and 2. The connector 10' comprises a U-shaped insulative housing 1', a plurality of contacts 3' and a pair of retention devices 2'.The housing 1' comprises a slot 11' for receiving an edge of a card (not shown), a plurality of cavities 12' for receiving the contacts 3' and a pair of arms 13' extending from opposite ends thereof each defining an aperture 14'.Each retention device 2' comprises a retention portion 21' having a pair of barbs 210' thereon and a solder plate 22' for being soldered onto a printed circuit board (not shown). Each retention device 2' is assembled in the corresponding arm 13' with the retention portion 21' thereof securely retained in the aperture 14' and the barbs 210' interferentially engaged with a periphery of the aperture 14'.However, since the retention devices 2' are securely retained in the arms 13' and are not adjustable in compliance with the arms 13', coplanarity between the solder plate 22' and the printed circuit board is difficult to obtain when the retention devices 2' are manufactured with low precision. Thus, it is difficult to securely solder the solder plates 22' on the printed circuit board. Hence, an improved electrical connector is required to overcome the disadvantages of the prior art.

BRIEF SUMMARY OF THE INVENTION

An object of the present invention is to provide a connector having a pair of retention devices adjustably retained in an insulative housing thereof to ensure coplanarity with a printed circuit board on which the connector is mounted.

Accordingly, an electrical connector comprises an insulative housing, a number of contacts received in the housing and a pair of retention devices. The housing comprises an elongate base defining a slot for receiving an edge of a card therein and a pair of arms laterally extending from opposite ends of the base. Each arm comprises a resilient cantilever and an aperture. Each retention device comprises a main portion, a spring arm and a horizontal solder pad soldered to a printed circuit board. The retention device is assembled to the corresponding arm with the main portion movably received in the aperture to ensure coplanarity between the horizontal solder pad and a bottom surface of the housing when the connector is mounted on a printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
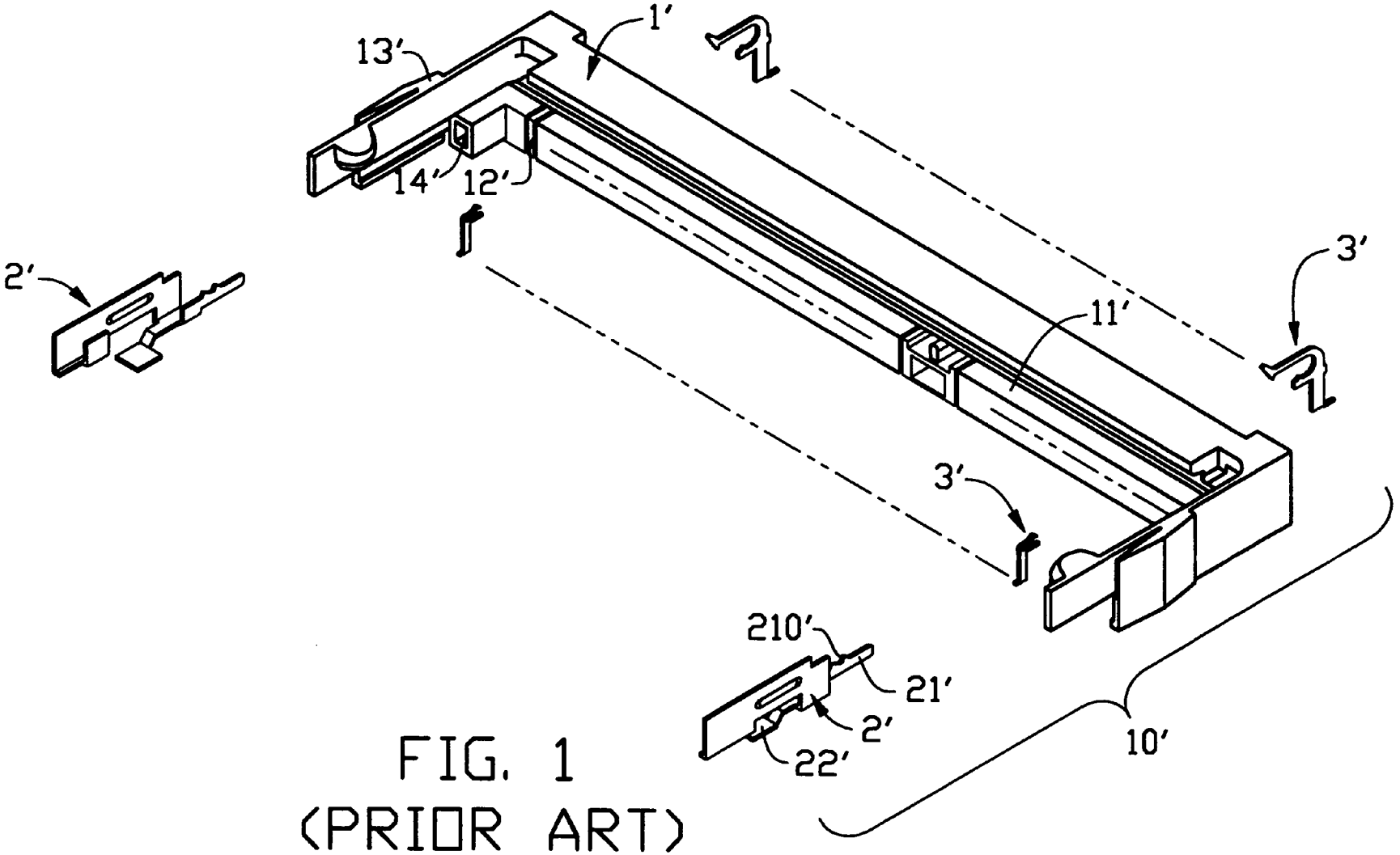
FIG. 1 (PRIOR ART)
FIG. 1 is an exploded view of a conventional electrical connector.
Figure 2:
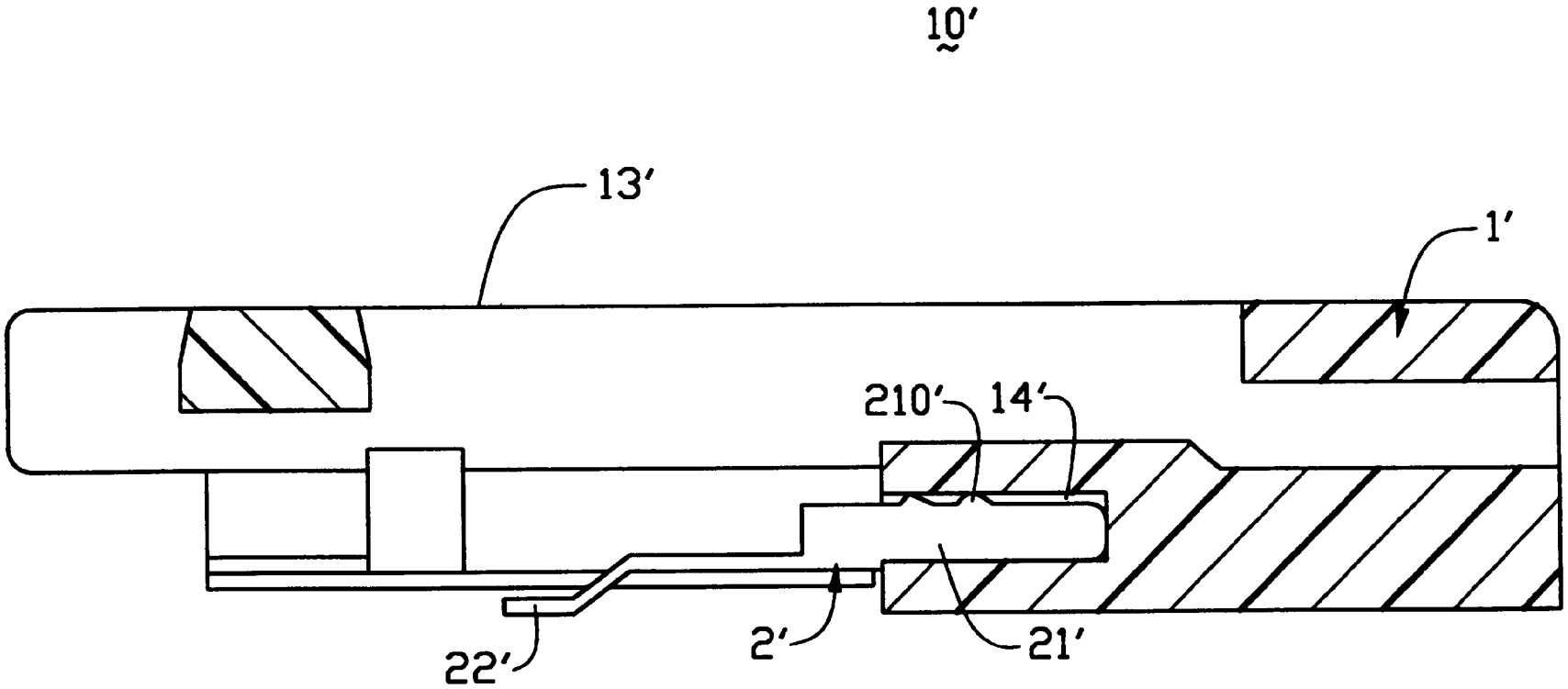
FIG. 2 (PRIOR ART)
FIG. 2 is a cross-sectional view of the assembled connector of FIG. 1.
Figure 3:
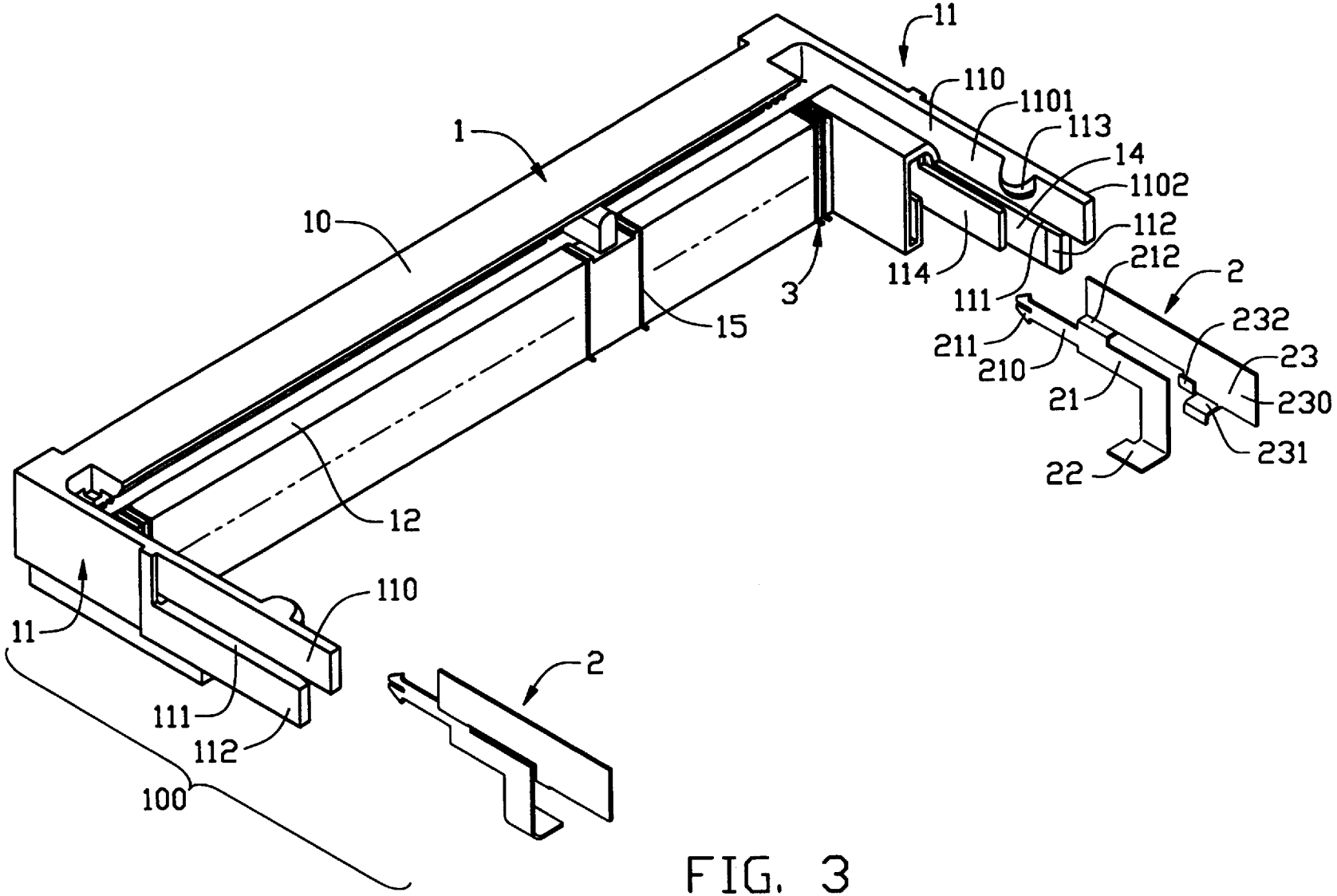
FIG. 3 is an exploded view of an electrical connector in accordance with the present invention.
Figure 4:
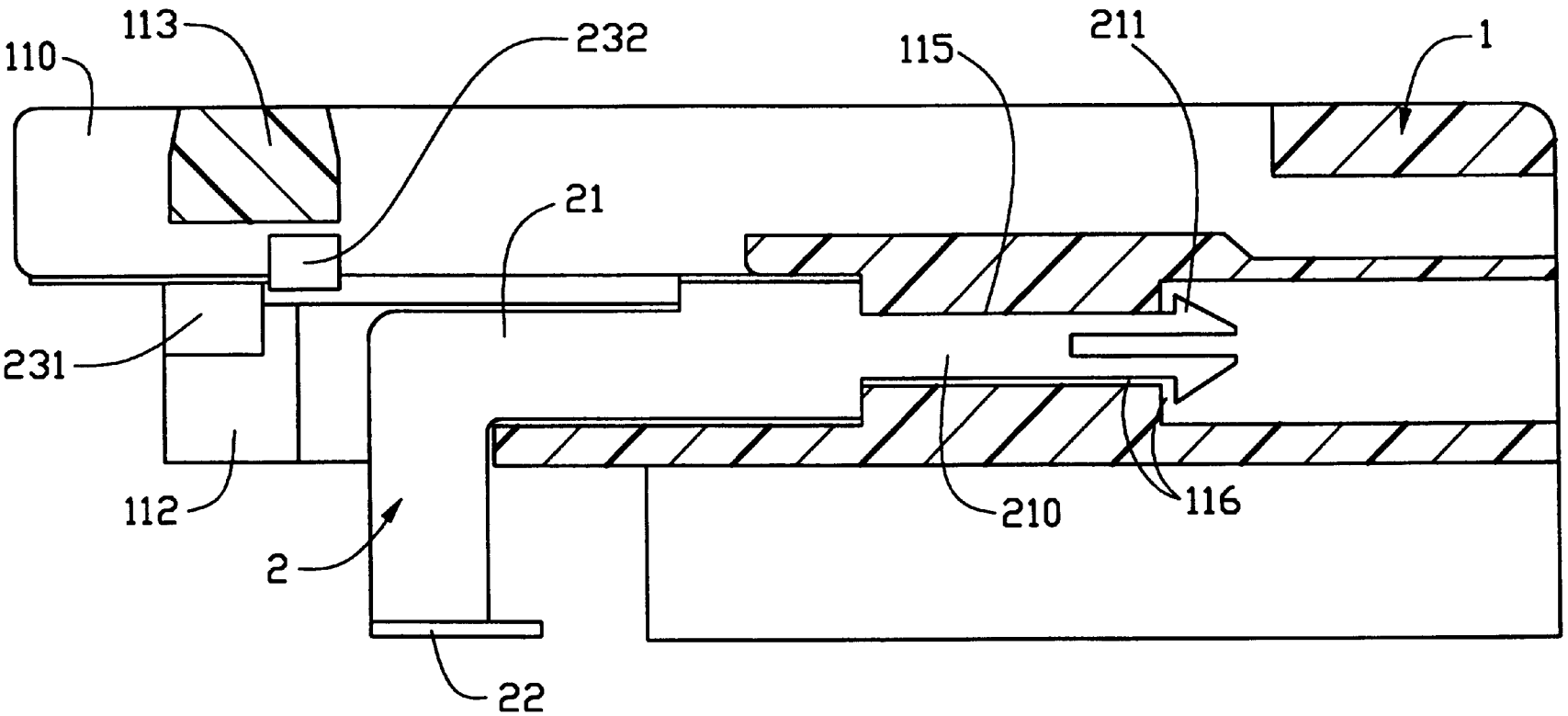
FIG. 4 is a cross-sectional view of the assembled connector of FIG. 3.

Referring to FIGS. 3 and 4, an electrical connector 100 in accordance with the present invention comprises a generally U-shaped insulative housing 1, a plurality of conductive contacts 3 and a pair of retention devices 2. The housing 1 includes an elongate base 10 and a pair of arms 11 laterally extending from opposite ends of the base 10. The base 10 defines a slot 12 and a plurality of cavities 15 for respectively receiving an edge of a card (not shown) and the contacts 3. Each arm 11 defines a channel 111 in a free end thereof to divide the arm 11 into a spring cantilever 110 and a first branch 112. The spring cantilever 110 forms a projection 113 on an inner surface 1101 thereof to prevent an upward movement of the edge of the card from the slot 12 after the card is engaged with the connector 100. Each arm 11 forms a second branch 114 proximate the first branch 112 with a space 14 defined therebetween. Each arm 11 further defines an aperture 115 in an end thereof extending into the base 10.

Each retention device 2 comprises an L-shaped main portion 21, a horizontal solder pad 22 and a spring arm 23. A finger 210 rearwardly extends from an end of a horizontal portion of the main portion 21 and forms a pair of hooks 211 at a distal end thereof. The horizontal solder pad 22 perpendicularly extends from an end of a vertical portion of the main portion 21. The spring arm 23 is connected to the main portion 21 at an end of the horizontal portion thereof by a connecting portion 212, thus an opposite end 230 of the spring arm 23 is laterally expandable with regard to the main portion 21 of the retention device 2. The spring arm 23 is laterally and upwardly offset a predetermined distance from the main portion 21 to abut against an outer surface 1102 of the spring cantilever 110. The spring arm 23 forms a pair of tabs 231, 232 proximate the opposite end 230 thereof. The tabs 231, 232 laterally extend from an edge of the spring arm 23 and then extend in opposite vertical directions.

In assembly, each retention device 2 is assembled to the corresponding arm 11 with the finger 210 received in the aperture 115, the main portion 21 accommodated in the space 14, the spring arm 23 abutting against the outer surface 1102 of the spring cantilever 110, and the upwardly extending tab 232 abutting against the inner surface 1101 of the spring cantilever 110. The aperture 115 is slightly wider than the finger 210 thereby defining a gap 116 between the finger 210/hook 211 and a periphery of the aperture 115. Thus, limited movement of the retention device 2 with regard to the arm 11 is permitted. The horizontal solder pad 22 is positioned at a level slightly lower than a bottom surface of the base 10 due to the provision of the gap 116 and the effects of gravity. When the connector 100 is mounted to a printed circuit board, the horizontal solder pad 22 abuts against the printed circuit board and is displaced thereby to ensure coplanarity between the bottom surface of the base 10 and the horizontal solder pad 22. When the spring cantilever 110 is outwardly deflected to accommodate the card in the connector 100, the spring arm 23 expands until the downwardly extending tab 231 abuts against an inner face of the first branch 112 to prevent overexpansion of the spring cantilever 110.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including an elongate base receiving a plurality of contacts therein and a pair of arms laterally extending from opposite ends of the base, the base defining a slot for receiving an edge of a card, each arm defining an aperture in an end thereof; and a pair of retention devices each including a main portion, a horizontal solder pad laterally extending from one end of the main portion, and a finger extending from an opposite end of the main portion, the finger being smaller than the aperture of the arm in size, the pair of retention devices being respectively assembled to the pair of arms of the housing, the finger being received in the aperture of the arm and being substantially upwardly and downwardly movable to ensure coplanarity between a bottom surface of the base and the horizontal solder pad; wherein the main portion of each retention device is generally L-shaped and comprises a horizontal portion and a vertical portion; and wherein each arm of the housing forms a spring cantilever and a first branch at the end hereof having the aperture; and wherein each retention device forms a spring arm beside the horizontal portion thereof, the spring arm abutting against an outer surface of the spring cantilever and the horizontal portion abutting against an inner surface of the first branch.

2. The electrical connector as claimed in claim 1, wherein the spring arm is upwardly and laterally offset a predetermined distance from the horizontal portion and connects with the horizontal portion at the end thereof proximate the finger.

3. The electrical connector as claimed in claim 2, wherein the spring arm forms a pair of tabs proximate a free end thereof, each tab laterally extending from an edge of the spring arm and then extending upwardly and downwardly, respectively.

4. The electrical connector as claimed in claim 1, wherein the horizontal solder pad is perpendicular to the vertical portion.

5. The electrical connector as claimed in claim 3, wherein the upwardly extending tab abuts against an inner surface of the spring cantilever, the spring arm being outwardly expandable in compliance with the spring cantilever when the edge of the card is inserted in the slot of the base.

6. The electrical connector as claimed in claim 3, wherein the downwardly extending tab abuts against the inner face of the first branch to prevent over-extension of the spring cantilever when the spring cantilever is outwardly deflected to accommodate the card.

* * * * *